US006592961B1

(12) United States Patent
Ruud et al.

(10) Patent No.: US 6,592,961 B1
(45) Date of Patent: Jul. 15, 2003

(54) BRICK MADE OF REFRACTORY MATERIAL

(75) Inventors: Anders Ruud, Årdalstangen (NO); Hogne Linga, Årdalstangen (NO)

(73) Assignee: Norsk Hydro ASA, Oslo (NO)

( * ) Notice: Subject to any disclaimer, the term of this patent is extended or adjusted under 35 U.S.C. 154(b) by 0 days.

(21) Appl. No.: 09/857,808

(22) PCT Filed: Dec. 8, 1999

(86) PCT No.: PCT/NO99/00370

§ 371 (c)(1),
(2), (4) Date: Jul. 25, 2001

(87) PCT Pub. No.: WO00/36241

PCT Pub. Date: Jun. 22, 2000

(30) Foreign Application Priority Data

Dec. 11, 1998 (NO) ..... 19985838

(51) Int. Cl.[7] ..... B32B 3/06

(52) U.S. Cl. ..... 428/99; 428/120; 428/156; 428/179; 110/338; 52/592.6

(58) Field of Search ..... 428/57, 99, 156, 428/179, 120; 110/338, 336; 52/592.6, 604; 432/247; 446/85, 124, 128

(56) References Cited

U.S. PATENT DOCUMENTS

| | | | | |
|---|---|---|---|---|
| 1,695,459 A | * | 12/1928 | Himmelright | 110/338 |
| 4,004,633 A | * | 1/1977 | Cronert | 165/9.1 |
| 4,026,086 A | | 5/1977 | Langley | |
| 4,107,894 A | | 8/1978 | Mullins | |
| 5,277,580 A | | 1/1994 | Miskolczi, Jr. | |
| 5,358,031 A | | 10/1994 | Hyde | |

FOREIGN PATENT DOCUMENTS

| | | |
|---|---|---|
| DE | 846 452 | 8/1952 |
| DE | 30 46 403 | 10/1981 |
| FR | 2 415 279 | 8/1979 |

* cited by examiner

*Primary Examiner*—Alexander S. Thomas
(74) *Attorney, Agent, or Firm*—Wenderoth, Lind & Ponack, L.L.P.

(57) ABSTRACT

A brick is made of refractory material, preferably for use in a furnace for calcining carbon bodies, wherein at least one surface of the brick that is facing towards an adjacent brick is provided with mating elements such as recesses and projections. The mating elements are rotationally symmetric about an axis that is perpendicular to the surface.

12 Claims, 1 Drawing Sheet

BRICK MADE OF REFRACTORY MATERIAL

BACKGROUND OF THE INVENTION

1. Field of the Invention

Figure 1:
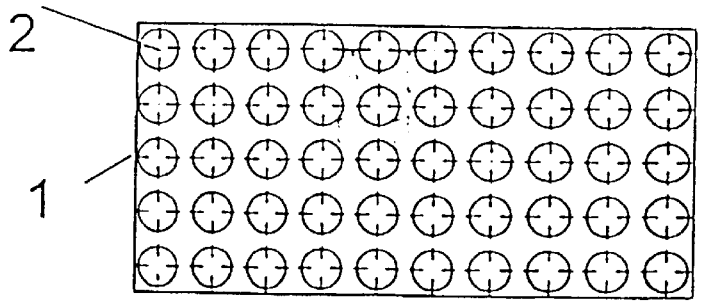

The present invention relates to a brick made of refractory material. More particularly, the invention relates to formed bricks that can be used as parts of construction elements in a furnace for calcining carbon bodies, where at least one of the surfaces of the bricks is provided with mating or interlocking elements. The mating elements cooperate with complementary mating elements in an adjacent brick.

2. Discussion of Related Art

WO 97/35150 relates to a design of refractory bricks to be used in a ring chamber furnace where the upper surface of the brick is provided with an arrangement of mating elements shaped as an elongated groove extending lengthwise along the complete length of the brick, together with crosswise extending grooves terminating short of the sides of the brick. The lower surface of the brick is formed in a similar manner with complementary projections that cooperates with a similar, underlying brick.

The system as described above has a rather complicated geometry that involves high costs related to production/maintenance of production tools in the manufacture of such bricks. Further, a system of grooves/tongues extending along the complete length of the brick could possibly involve a risk of leakage of gas through the wall, as a result of gas leakage through the layers between adjacent bricks. Particularly in calcining furnaces, such leakages may generate problems with respect to burn-off in carbon bodies caused by air entering the chamber where the calcining process takes place. Another problem related to longitudinal grooves/tongues extending approximately along the complete length and width of the brick, is that such grooves/tongues may represent regions of tension concentration where weakening lines or crack formation may occur, which in a worst case may indicate that the brick is cracking wholly or partly, leading to leakages or weakening of the overall wall construction.

FR 2 415 279 discloses a refractory brick for use in a furnace where the brick has mating elements, such as projections, at is upper surface and recesses in its lower surface. The mating elements may be circular and have the shape of a cut-off cone.

SUMMARY OF THE INVENTION

The present invention relates to refractory brick for use in a calcining furnace of the calcining of carbon bodies. In such a furnace, the brick work will be exposed to great cyclic temperature variations, typically from room-temperature and up to about 1250° C. Such cycles may introduce tension forces in the brick work and initiate creeping, in particular, during the course of time. Bricks in accordance with the present invention has so far shown promising results with respect to endurance and stability.

With the present invention, a novel design of a brick where the above mentioned disadvantages can be avoided is achieved. The brick in accordance with the invention can be manufactured at low costs, as the shaping tool used in the pressing of the brick before burning has a simple and rugged geometry. Further, the geometric shape of the brick makes possible to reduce the number of different types of bricks that are included in a calcining furnace. The fact that this number can be reduced indicates that the logistics with respect to maintenance and repair work can be simplified, and that the constructional drawings of the furnace can be simplified. Following this, the construction period for a furnace can be reduced.

BRIEF DESCRIPTION OF THE INVENTION

Figure 2A:
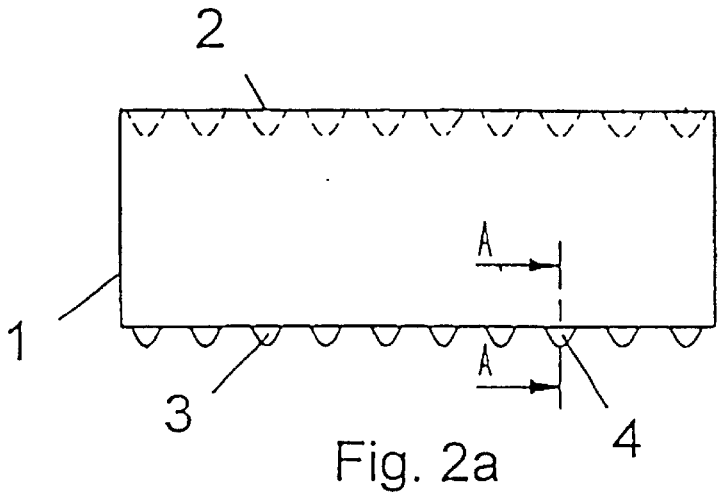
Figure 2B:
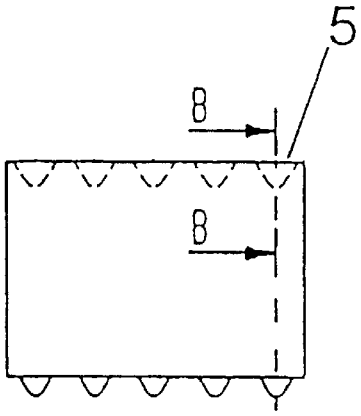
Figure 3A:
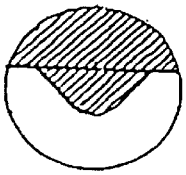

In the following, the present invention will be further described by example and Figures where:

FIG. 1 shows a formed brick in accordance with the invention, seen from above;

FIG. 2*a* shows the formed brick as shown in FIG. 1, seen from one side;

FIG. 2*b* shows the formed brick as shown in FIG. 1, seen in front;

FIG. 3*a* shows the cut through A—A, as shown in FIG. 2*a*; and

Figure 3B:
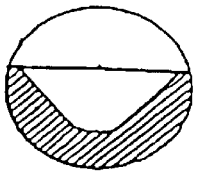

FIG. 3*b* shows the cut through B—B, as shown in FIG. 2*b*.

DETAILED DESCRIPTION OF THE INVENTION

The formed brick 1, as shown in FIG. 1, is provided with mating elements at its upper surface, where the mating elements are constituted by a plurality of recesses 2. In the embodiment shown in the Figure, there are arranged ten circular or rotational symmetric recesses 2 in each of five rows. It should be understood that the number of recesses 2 and the arrangement of these in relation to the long side and the short side of the brick can deviate from that shown in FIG. 1.

FIG. 2*a* shows in side view the formed brick 1 as shown in FIG. 1, having the recesses 2 at the upper surface of the brick 1. As seen from the Figure, there are arranged mating elements at the lower surface of the brick, formed as projections 3. The number of projections 3 can appropriately be the same as the number of recesses 2, and the projections 3 preferably have the same positions as the recesses 2 related to coordinates in the horizontal plane, i.e., the projections 3 are respectively centrically arranged relative a vertical axis through each of the recesses 2. It should be understood that the brick may alternatively be arranged in such a manner that the projections 3 are arranged at the upper surface of the brick, while the recesses 2 are arranged at its lower surface.

FIG. 3*a* shows an enlarged portion of the cut through A—A in FIG. 2*a*, and illustrates a projection 4. The geometry of the projection 4 is preferably rotationally symmetric and has in this embodiment, a rounded off cone shape where its top is rounded off.

FIG. 3*b* shows an enlarged portion of the cut through B—B in FIG. 2*b*, and illustrates a recess 5. The geometry of the recess 5 is preferably rotationally symmetric and has in this embodiment, a rounded off cone shape where its bottom is rounded off.

It should be understood that other geometrical designs of the projections and the recesses than shown here may be used as well. For instance, the form of these mating elements can be dome-shaped or hemispherical. Meanwhile, it is of great importance that shape of the projections and recesses are mutually complementary in shape, i.e., they engage each other with little clearance, where the projections have a geometric extension that is a little bit smaller than that of the recesses.

The manufacture of production tools for producing bricks having rotationally symmetric projections will be simple.

The projections in the brick can, for instance, be provided by milling recesses in the surface of the mould using a suitable milling tool (not shown). Appropriately, the recesses in the brick are manufactured by rotationally symmetric projections in the surface of the mould. For instance, such projections may be fixed to the mould surface in a simple manner, for example, by screws or other fastening means (not shown). The projections themselves may be produced in a moulding or similar process.

Bricks in accordance with the present invention make possible the construction of long and slender furnace walls, which results in that the net volume inside the furnace can be increased as compared to previous furnaces with similar outer dimensions. In use, the bricks have shown the ability to sustain a stable mutual locking to each other, which essentially reduces problems related to settle effects and bowing-out of the wall. Between the brick layers, mortar is used to even out possible small deviations and to provide an increased binding/sealing between the layers.

Bricks produced in accordance with the proposed geometry have shown the ability to sustain a reduced deviation in their shape (tolerance deviation) in the pressing and burning processes, as compared to previous bricks during manufacture. The fact that bricks now can be reproduced with small deviations renders great simplifications in the construction work, together with a reduction in the amount of mortar consume. Further, the improved accuracy in the shape of the bricks positively influences the stability and lifetime duration of the wall.

It should be understood that the brick may be provided with mating elements on more than one surface within the scope of the claims. For instance, the top and bottom surface of the brick can be provided with such elements, as well as one or more side surfaces. In the latter, the mating elements may be of the same type as described above.

What is claimed is:

1. A brick made of refractory material, said brick comprising at least one surface to be arranged towards an adjacent brick, said at least one surface being provided with a plurality of mating elements, each of said plurality of mating elements having a rounded cone shape and being one of a recess and a projection, and said plurality of mating elements being substantially rotationally symmetric about an axis that is perpendicular to said at least one surface.

2. A brick in accordance with claim 1, wherein said at least one surface is at least two surfaces including an upper surface and a lower surface, said upper surface having a plurality of recesses arranged thereat and said lower surface having a plurality of projections arranged thereat.

3. A brick in accordance with claim 1, wherein said at least one surface is at least two surfaces including an upper surface and a lower surface, said upper surface having a plurality of projections arranged thereat and said lower surface having a plurality of recesses arranged thereat.

4. A brick in accordance with claim 1, wherein said at least one surface is at least one side surface.

5. A brick in accordance with claim 1, wherein said at least one surface is at least two surfaces opposite to each other, a first surface of said at least two surfaces having a plurality of recesses arranged thereat and a second of said at least two surfaces having a plurality of projections arranged thereat.

6. A method comprising constructing a furnace for calcining carbon bodies using a brick, the brick being made of a refractory material, the brick comprising at least one surface to be arranged towards an adjacent brick, the at least one surface being provided with a plurality of mating elements, each of the plurality of mating elements having a rounded cone shape and being one of a recess and a projection, and the plurality of mating elements being substantially rotationally symmetric about an axis that is perpendicular to the at least one surface.

7. A brick comprising at least one surface to be arranged towards an adjacent brick, said at least one surface being provided with a plurality of mating elements, each of said plurality of mating elements having a rounded cone shape and being one of a recess and a projection, and said plurality of mating elements being substantially rotationally symmetric about an axis that is perpendicular to said at least one surface.

8. A brick in accordance with claim 7, wherein the at least one surface is at least two surfaces including an upper surface and a lower surface, the upper surface having a plurality of recesses arranged thereat and the lower surface having a plurality of projections arranged thereat.

9. A brick in accordance with claim 7, wherein the at least one surface is at least two surfaces including an upper surface and a lower surface, the upper surface having a plurality of projections arranged thereat the said lower surface having a plurality of recesses arranged thereat.

10. A brick in accordance with claim 7, wherein the at least one surface is at least one side surface.

11. A brick in accordance with claim 7, wherein said at least one surface is at least two surfaces opposite to each other, a first surface of said at least two surfaces having a plurality of recesses arranged thereat and a second of said at least two surfaces having a plurality of projections arranged thereat.

12. A method comprising constructing a furnace for calcining carbon bodies using a brick comprising at least one surface to be arranged towards an adjacent brick, the at least one surface being provided with a plurality of mating elements, each of the plurality of mating elements having a rounded cone shape and being one of a recess and a projection, and the plurality of mating elements being substantially rotationally symmetric about an axis that is perpendicular to the at least one surface.

* * * * *